US007719173B2

(12) United States Patent
Tsuzuki et al.

(10) Patent No.: US 7,719,173 B2
(45) Date of Patent: May 18, 2010

(54) ELECTRODELESS DISCHARGE LAMP AND LIGHTING APPARATUS USING THE SAME

(75) Inventors: Yoshinori Tsuzuki, Osaka (JP); Kazuhiko Sakai, Osaka (JP); Shin Ukegawa, Kyotanabe (JP); Shigeki Matsuo, Nishikambara-gun (JP)

(73) Assignee: Panasonic Electric Works Co., Ltd., Osaka (JP)

( * ) Notice: Subject to any disclaimer, the term of this patent is extended or adjusted under 35 U.S.C. 154(b) by 288 days.

(21) Appl. No.: 11/909,336

(22) PCT Filed: Mar. 23, 2006

(86) PCT No.: PCT/JP2006/305778

§ 371 (c)(1),
(2), (4) Date: Sep. 21, 2007

(87) PCT Pub. No.: WO2006/101153

PCT Pub. Date: Sep. 28, 2006

(65) Prior Publication Data

US 2009/0051291 A1 Feb. 26, 2009

(30) Foreign Application Priority Data

Mar. 23, 2005 (JP) ..... 2005-084862

(51) Int. Cl.
*H01J 1/50* (2006.01)
*H01J 61/33* (2006.01)

(52) U.S. Cl. ..... 313/160; 313/153; 313/161; 313/493; 313/634

(58) Field of Classification Search ..... 313/153–162, 313/634, 493
See application file for complete search history.

(56) References Cited

U.S. PATENT DOCUMENTS 5,789,855 A * 8/1998 Forsdyke et al. ..... 313/490

(Continued)

FOREIGN PATENT DOCUMENTS

JP 6-005006 1/1994

(Continued)

OTHER PUBLICATIONS

English language Abstract of JP 2001-325920.

(Continued)

*Primary Examiner*—Mariceli Santiago
(74) *Attorney, Agent, or Firm*—Greenblum & Bernstein P.L.C.

(57) ABSTRACT

An electrodeless discharge lamp has a bulb into which a discharge gas and a mercury, which is controlled at a temperature of a coldest spot are filled. A power coupler generates a high frequency electromagnetic field. A ferrule couples the bulb and the power coupler. The bulb is configured as a substantially spherical barrel formed of a transparent material and has an opening. A sealing member is welded to the opening of the barrel having a substantially cylindrical cavity. A protrusion, which becomes the coldest spot when the lamp is lit in a state that the ferrule is disposed upward, is formed at an apex of the bulb. A protruding portion is formed in a vicinity just above the ferrule of the bulb, that is, in a bulb neck portion, so that the bulb neck portion becomes the coldest spot when the lamp is lit in a state that the ferrule is disposed downward. Thereby, a constant optical output is obtained, regardless of a posture of installation of the electrodeless discharge lamp.

2 Claims, 7 Drawing Sheets

U.S. PATENT DOCUMENTS 5,834,890 A 11/1998 Girach

FOREIGN PATENT DOCUMENTS

| | | | |
|---|---|---|---|
| JP | 7-272688 | | 10/1995 |
| JP | 8-153489 | | 6/1996 |
| JP | 09063543 A | * | 3/1997 |
| JP | 9-320522 | | 12/1997 |
| JP | 10-092390 | | 4/1998 |
| JP | 2001-325920 | | 11/2001 |

OTHER PUBLICATIONS

English language Abstract of JP 9-320522.
English language Abstract of JP 8-153489.
English language Abstract of JP 10-092390.
English language Abstract of JP 7-272688.
English language computer-generated translation of JP 6-005006 U.

* cited by examiner

ELECTRODELESS DISCHARGE LAMP AND LIGHTING APPARATUS USING THE SAME

TECHNICAL FIELD

The present invention relates to an electrodeless discharge lamp having no electrode in a bulb into which discharge gas is filled, and generates discharge in the discharge gas by liberating high frequency electromagnetic field generated by supplying high frequency current to an induction coil to the discharge gas, and relates to a lighting apparatus using the same.

BACKGROUND ART

The electrodeless discharge lamp is configured that the discharge gas filled in the bulb is activated by high frequency electromagnetic field generated by supplying high frequency current to the induction coil, and ultraviolet light emitted at that time is converted into visible light through fluorescent material. Since the electrodeless discharge lamp apparatus has a configuration that no electrode inside, non-lighting due to deterioration of the electrode may not occur, and thus, it is relatively longevity life in comparison with generic fluorescent lamp.

In a conventional electrodeless discharge lamp shown in Japanese Laid-Open Patent Publication No. 7-272688 or Japanese Laid-Open Utility Model Publication No. 6-5006, for example, uses a bismuth-indium amalgam as a luminescent material. According to this amalgam, it is possible to obtain a higher optical output in a wide range than the optical output at ambient air temperature 25 degrees Celsius, even when ambient air temperature changes. On the other hand, although a high mercury vapor pressure is necessary to realize a high optical output, there, however, is a disadvantage that start-up of the lamp is slower because a time until reaching a temperature value that it is necessary for evaporation of mercury. When the bismuth-indium amalgam was used, a consequence that it is necessary for approximately 1 minute to secure optical output of 60% with respect to optical output at the time of stable lighting was provided.

In contrast, a pure mercury drop is used for the discharge gas to shorten the start-up time in an electrodeless discharge lamp shown in Japanese Laid-Open Patent Publication No. 2001-325920. According to this document, it is mentioned that the optical output was reached 50% of maximum output within two or three seconds after the lamp was activated. This is because the mercury drop needs a shorter time until reaching the temperature value necessary for evaporation than amalgam. When an input power is much larger with respect to a volume of the bulb, or when the ambient air temperature is higher, temperature value of the bulb rises, and mercury vapor pressure falls down adversely, and thus, the optical output falls.

When an amalgam was used as above, variation of optical output is small regardless of variation of ambient air temperature. In contrast, when mercury drop is used, mercury vapor pressure is largely varied corresponding to variation of ambient air temperature, and thus, optical output fall. Accordingly, when mercury drop is used, it is necessary to secure a coldest spot (a portion of a surface of a bulb where temperature value becomes the lowest) so as to control mercury vapor pressure. The temperature is around 35-45 degrees Celsius.

By the way, in an electrodeless discharge lamp shown in Japanese Laid-Open Patent Publication No. 2001-325920, when installation posture thereof is changed, the coldest spot of the bulb is changed. For example, when the lamp is lit in a posture that a ferrule or a cap thereof is disposed upward (hereinafter, it is called "base-up lighting"), a protrusion formed at an apex of the bulb becomes the coldest spot. Alternatively, when the lamp is lit in a posture that a ferrule thereof is disposed downward (hereinafter, it is called "base-down lighting"), a portion of the bulb just above the ferrule becomes the coldest spot. When the volume of the bulb is small, a volume of a portion where discharge occurs becomes relatively larger with respect to the volume of the bulb, so that it is difficult to maintain temperature at the coldest point constant regardless of the posture of installation of the electrodeless discharge lamp. Although temperature at the protrusion of the bulb in the base-up lighting can be controlled by changing a diameter and a height of the protrusion, it is a problem to control temperature at a bulb neck portion in the base-down lighting.

DISCLOSURE OF INVENTION

The present invention is conceived to solve the above mentioned problems, and a purpose of the present invention is to provide an electrodeless discharge lamp a lighting apparatus using the same, which can maintain a high optical output even when the posture of installation is changed by providing the coldest spot in the bulb and controlling the temperature of the coldest spot.

An electrodeless discharge lamp in accordance with an aspect of the present invention comprises a bulb into which discharge gas and mercury which is controlled at a temperature of a coldest spot are filled, a power coupler generating high frequency electromagnetic field, and a ferrule for coupling the bulb and the power coupler, wherein the bulb is configured of a barrel formed of a transparent material and having an opening, and a sealing member welded to the opening of the barrel and having a cylindrical cavity;

a protrusion, which becomes a coldest spot when the lamp is lit in a state that the ferrule is disposed upward, is formed at an apex of the bulb; and a protruding portion is formed in a vicinity of a portion of the bulb just above the ferrule so that the vicinity of the portion of the bulb just above the ferrule serves as a coldest spot when the lamp is lit in a state that the ferrule is disposed downward.

According to such a configuration, when the lamp is lit in the state that the ferrule is disposed upward (base-up lighting), the protrusion formed at the apex of the bulb becomes as the coldest spot, so that temperature of the protrusion can be controlled by changing a diameter and a height of the protrusion, similar to the conventional case. On the other hand, when the lamp is lit in the state that the ferrule is disposed downward (base-down lighting), doctrine is different according to the orientation where the protruding portion is formed. When the protruding portion is formed to protrude inward of the bulb, a volume of a discharge space near to the protruding portion is partially shrunk, so that luminescence in the vicinity of the protruding portion is restrained when the electrodeless discharge lamp is lit in base-down lighting, and a part of heat generated corresponding to the luminescence is shielded by the protruding portion. Consequently, a temperature rise of the portion just above the ferrule, that is, the bulb neck portion is restrained, and thus, the bulb neck portion becomes the coldest spot. When the protruding portion is formed to protrude outward of the bulb, inside concavity of the protruding portion is positioned away from a portion where the discharge actually occurs, so that heat generated corresponding to the luminescence is hard to transmit to the protruding portion.

Consequently, a temperature rise in the protruding portion is restrained, and thus the protruding portion becomes the coldest spot. In this way, although a location of the coldest spot is changed corresponding to the posture of installation of the electrodeless discharge lamp, the temperature value of the coldest spot can be maintained substantially constant in each case, so that a constant optical output is provided regardless of the posture of installation of the electrodeless discharge lamp.

BEST MODE FOR CARRYING OUT THE INVENTION

First Embodiment

Figure 1:
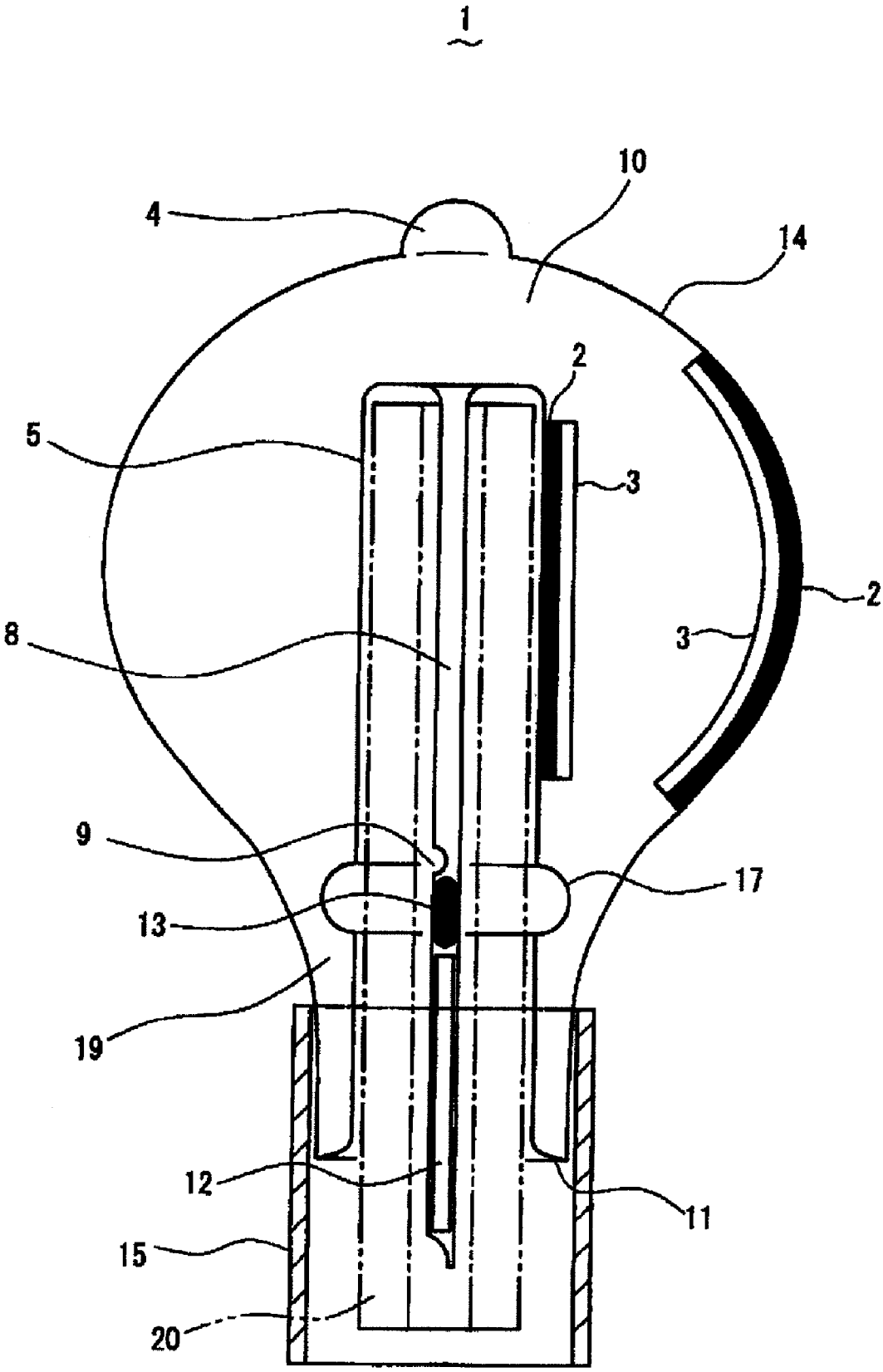
FIG. 1 is a sectional view showing a configuration of an electrodeless discharge lamp in accordance with a first embodiment of the present invention.

At first, an electrodeless discharge lamp in accordance with a first embodiment of the present invention is described. FIG. 1 shows a configuration of an electrodeless discharge lamp according to the first embodiment. The electrodeless discharge lamp 1 according to the first embodiment comprises a bulb 10 into which discharge gas and mercury which is controlled with temperature of the coldest spot, and a power coupler 20 which generates high frequency electromagnetic field. The bulb 10 is a hermetic container configured of a substantially spherical barrel 14 formed of a transparent material and having a circular opening, and a sealing member 11 welded to the circular opening of the barrel 14 and having a substantially cylindrical cavity 5 and an exhaust tube 8 formed at a center portion of the cavity 5. As illustrated by two-dotted chain line in FIG. 1, the power coupler 20 is configured of an induction coil for generating an induction field and a ferrite core, and engaged with the cavity 5 so that the exhaust tube 8 is located at the center thereof.

A protective coating 2 and a phosphor coating 3 are applied to an inner peripheral face of the spherical barrel 14. Similarly, the protective coating 2 and the phosphor coating 3 are applied to an outer peripheral face of the cavity 5 of the sealing member 11 (It is partially illustrated in the figure). Therefore, the protective coating 2 and the phosphor coating 3 are applied to substantially whole area of an inner peripheral face of the bulb 10. In addition, metal oxide such as $Al_2O_3$ is used as a binding agent of the fluorescent material, and the phosphor coating 3 is protected by increasing quantity of addition of the agent so as to prevent deterioration of the fluorescent material. As for the binding agent, $Y_2O_3$ or MgO can be used other than $Al_2O_3$.

A ferrule 15, which is formed of a resin material, is attached to a bulb neck portion 19 near to the bottom of the bulb 10 by an adhesive, for example. A mounting structure such as a bayonet not show in the figure is provided on the ferrule 15 and a pedestal of the power coupler 20, respectively, so that the bulb 10 which is integrated with the ferrule 15 is detachably attached to the power coupler 20.

A protrusion 4 is formed at an apex of the bulb 10 so that it becomes the coldest shot when the lamp is lit in a state that the ferrule 15 is disposed upward (base-up lighting). In addition, an annular protruding portion 17, which protrude inward of the bulb 10 along an outer peripheral face of the cavity 5, is formed in the vicinity of the welded portion of the barrel 14 and the sealing member 11 of the bulb 10, that is, the sealed portion of the bulb 10, more precisely, a portion just above the ferrule 15 in a state that the ferrule 15 is disposed below. When the lamp is lit in the state that the ferrule 15 is disposed below (base-down lighting), the protruding portion 17 functions as a discharge shielding means so that the vicinity of the protruding portion 17 becomes the coldest spot. Details are described later.

A rare gas such as argon or krypton is enclosed in the inside of the bulb 10. In addition, a metal container 13 made of iron-nickel alloy is established in an inside of the exhaust tube 8, and Zn—Hg of total quantity about 17 mg and 50:50 of a weight ration is filled in the metal container 13 so as to emit mercury for controlling mercury vapor pressure. Moreover, a recess 9 is formed on an inner peripheral face of the exhaust tube 8 to fix a location of the metal container 13, and a glass rod 12 is provided in the exhaust tube 8.

Figure 2:
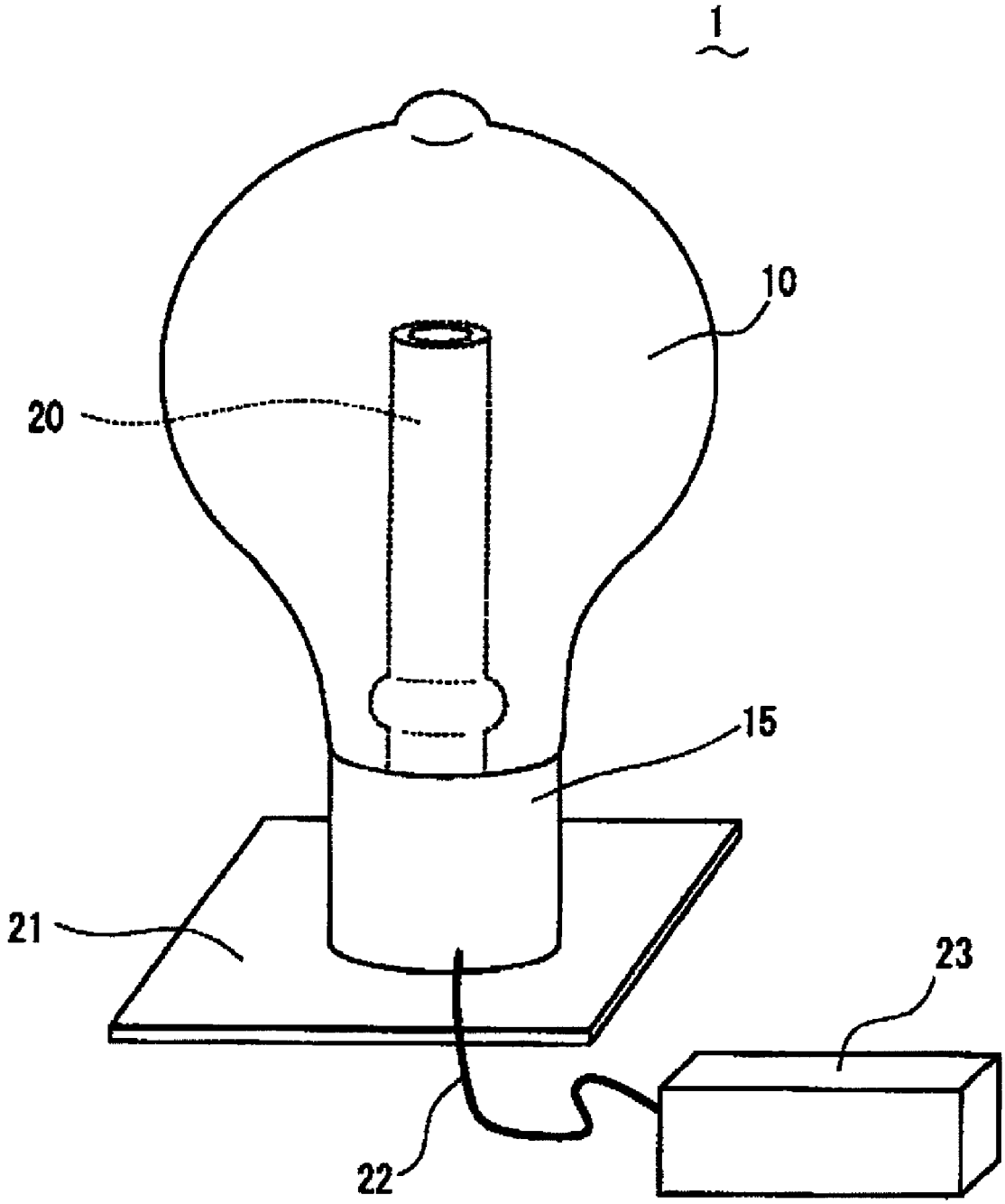
FIG. 2 is a perspective view showing a configuration of a lighting apparatus comprising the electrodeless discharge lamp in accordance with the first embodiment of the present invention.

Subsequently, a lighting apparatus in accordance with the first embodiment is described. FIG. 2 shows a configuration of the lighting apparatus comprising the electrodeless discharge lamp according to the first embodiment of the present invention. In addition, the configuration of this lighting apparatuses is similar in the second to fourth embodiment which will be described later.

The power coupler 20 constituting the electrodeless discharge lamp 1 is fixed on a heatsink 21, and the heatsink 21 is installed on a ceiling, a side wall, or a floor of a building. The power coupler 20 is configured of an induction coil for generating high frequency electromagnetic field and a ferrite core, and terminals of the induction coil are connected to a lightning circuit 23 through an electric cable 22. Then, the lighting apparatus comprising the electrodeless discharge lamp 1 is configured when the bulb 10 which is integrated with the ferrule 15 is attached to the power coupler 20. Since a high frequency current supplied to the induction coil of the power coupler 20 has a lower frequency of several hundred kHz, the ferrite core (magnetic core) inside the induction coil.

When a high-frequency current is flown into the induction coil of the power coupler 20, a high frequency electromagnetic field occurs around the induction coil. Electrons in the bulb 10 are accelerated by such high frequency electromagnetic field, so that electrolytic dissociation occurs due to collision of electrons, and thus, discharge occurs. While discharge occurs, the discharge gas filled in the bulb 10 is activated, and ultra-violet light occurs when activated atoms come back to ground state. This ultra-violet light is converted to visible light with the phosphor coating 3 applied to the inner peripheral face of the bulb 10. The visible light passes through the barrel 14 of the bulb 10 so that it is emitted outward.

In the electrodeless discharge lamp 1 according to the first embodiment, since the protruding portion 17 is formed just above the ferrule 15 of the bulb 10, that is, in the bulb neck portion 19, a volume of a discharge space in the vicinity of the protruding portion 17 is partially shrunk. When the electrodeless discharge lamp 1 is lit in the base-down lighting, luminescence in the vicinity of the protruding portion 17 is restrained, and a part of heat which occurs following to the luminescence is shielded by the protruding portion 17. Consequently, a temperature rise of the bulb neck portion 19 is restrained, and thus, the bulb neck portion 19 becomes the coldest spot. On the other hand, when the lamp is lit in the base-up lighting, the protrusion 4 formed at the apex of the bulb 10 becomes the coldest spot similar to the conventional case. In this way, although a location of the coldest spot is changed corresponding to the posture of installation of the electrodeless discharge lamp 1, it was confirmed that the temperature value of the coldest spot could be maintained substantially constant in each case, when the temperature of the coldest spot was measured. Consequently, a constant optical output can be provided regardless of the posture of installation of the electrodeless discharge lamp 1.

In the above mentioned first embodiment, although the protruding portion 17 is formed annularly along a circumferential direction of the cavity 5, it, however, is not limited to this. It is sufficient that the protruding portion 17 should be formed at least a portion of the outer peripheral face of the cavity 5. Alternatively, the protruding portion 17 may be formed at a plurality of portions along the circumferential direction of the cavity 5.

Second Embodiment

Figure 3:
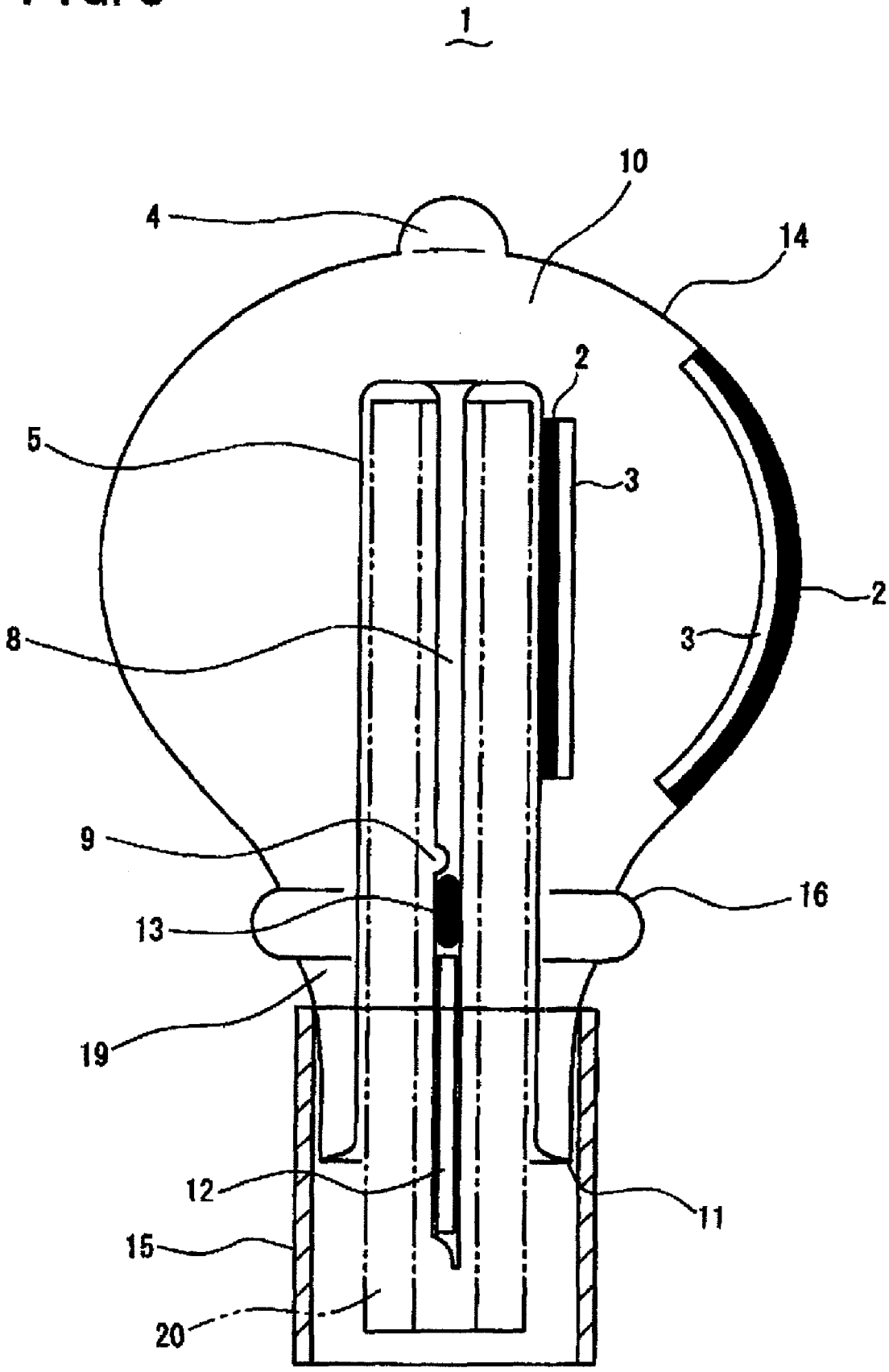
FIG. 3 is a sectional view showing a configuration of an electrodeless discharge lamp in accordance with a second embodiment of the present invention.

Subsequently, an electrodeless discharge lamp in accordance with a second embodiment of the present invention is described. FIG. 3 shows a configuration of an electrodeless discharge lamp according to the second embodiment. Since the portions, to which the same codes as those of the electrodeless discharge lamp according to the first embodiment shown in FIG. 1 are applied, are substantially the same, description of them is omitted.

In the second embodiment shown in FIG. 3, an annular protruding portion 16, which protrudes outward along the circumferential direction of the barrel 14 constituting the bulb 10, is formed in the vicinity of the sealing portion of the bulb 10, that is, just above the ferrule 15 when the ferrule 15 is disposed upward. In this way, since the protruding portion 16 is formed to protrude outward of the bulb 10, an inside concavity of the protruding portion 16 is positioned away from a portion where discharge actually occurs, and thus, heat generated corresponding to the luminescence is hard to transmit to the protruding portion 16. Consequently, a temperature rise in the protruding portion 16 is restrained. When the electrodeless discharge lamp 1 is lit in the base-down lighting, the protruding portion 16 becomes the coldest spot. On the other hand, when the electrodeless discharge lamp 1 is lit in the base-up lighting, the protrusion 4 formed at the apex of the bulb 10 becomes the coldest spot similar to the first embodiment. In this way, although a location of the coldest spot is changed corresponding to the posture of installation of the electrodeless discharge lamp 1, it was confirmed that the temperature value of the coldest spot could be maintained substantially constant in each case, when the temperature of the coldest spot was measured. Consequently, a constant optical output can be provided regardless of the posture of installation of the electrodeless discharge lamp 1.

In the above mentioned second embodiment, although the protruding portion 16 is formed annularly along a circumferential direction of the barrel 14, it, however, is not limited to this. It is sufficient that the protruding portion 16 should be formed at least a portion of the outer peripheral face of the barrel 14. Alternatively, the protruding portion 16 may be formed at a plurality of portions along the circumferential direction of the barrel 14.

Figure 4:
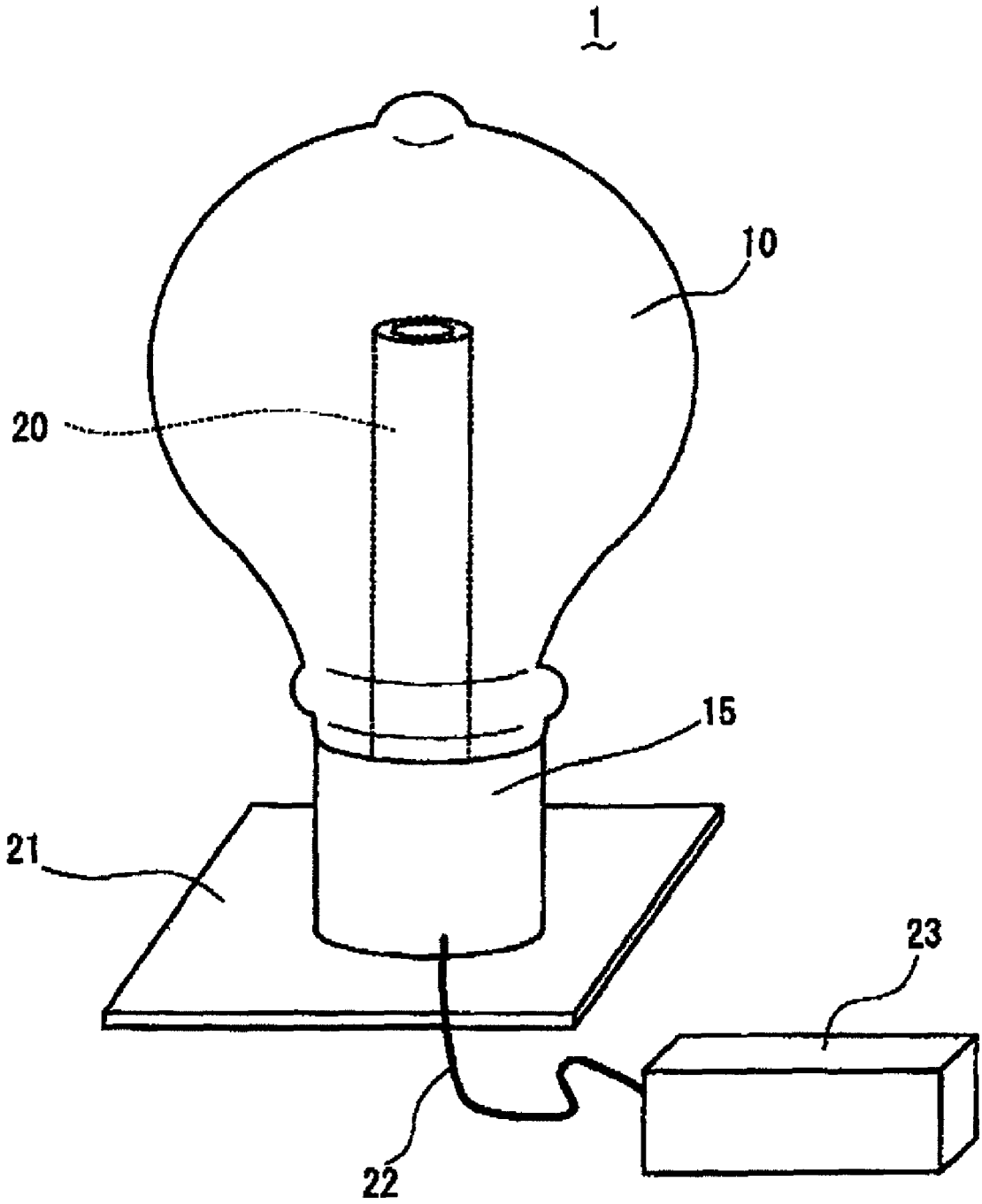
FIG. 4 is a perspective view showing a configuration of a lighting apparatus comprising the electrodeless discharge lamp in accordance with the second embodiment of the present invention.

FIG. 4 shows a configuration of a lighting apparatus comprising the electrodeless discharge lamp according to the second embodiment of the present invention. In addition, since the configuration of this lighting apparatus is different only the shape of the bulb 10 from the lighting apparatus of the above mentioned first embodiment, the description is omitted.

Third Embodiment

Figure 5:
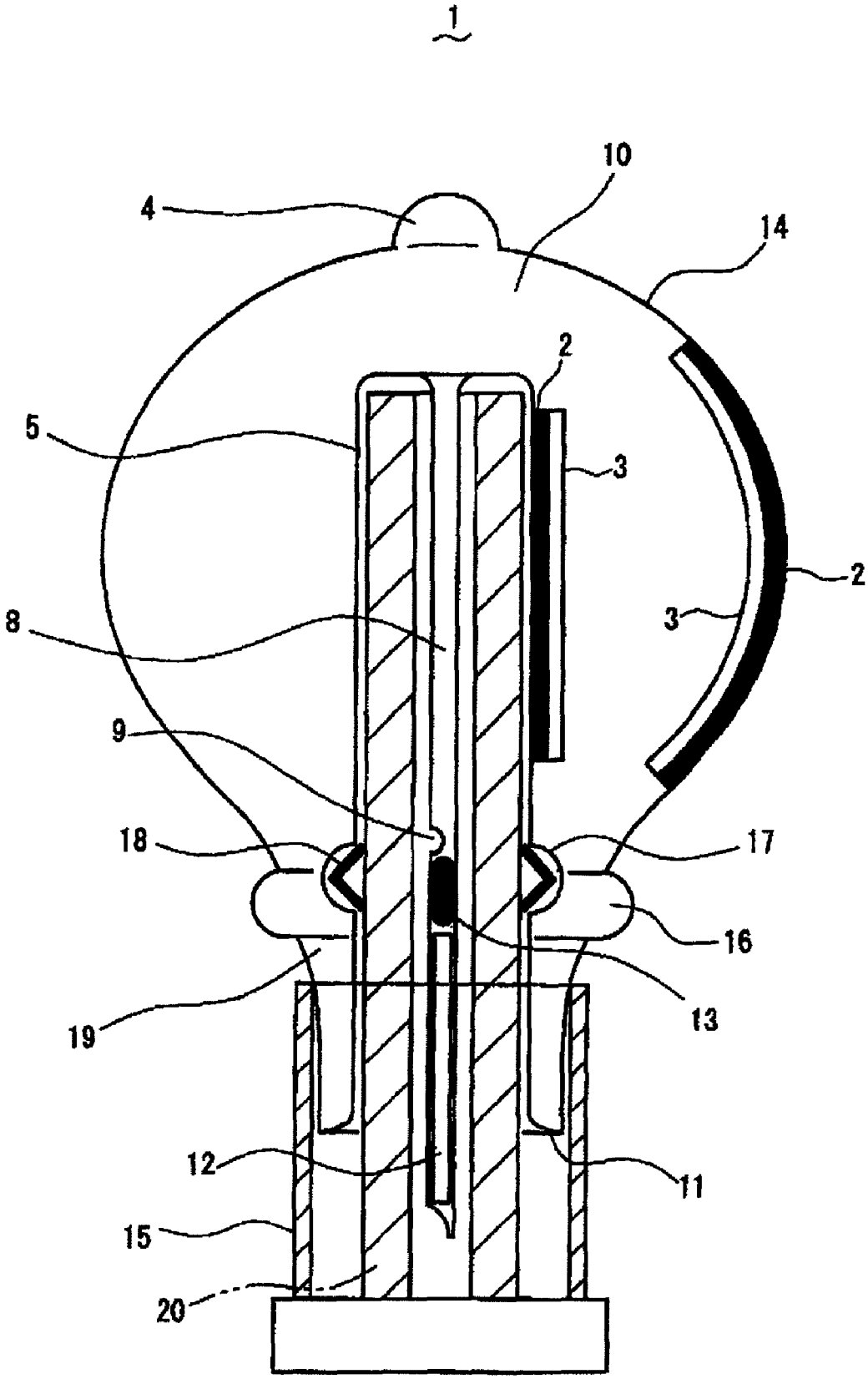
FIG. 5 is a sectional view showing a configuration of an electrodeless discharge lamp in accordance with a third embodiment of the present invention.

Subsequently, an electrodeless discharge lamp in accordance with a third embodiment of the present invention is described. FIG. 5 shows a configuration of an electrodeless discharge lamp according to the third embodiment. In FIG. 5, the power coupler 20 to be fit into the cavity 5 is also illustrated by solid lines. In addition, since the portions, to which the same codes as those of the electrodeless discharge lamp according to the first embodiment shown in FIG. 1 or the second embodiment show in FIG. 3 are applied, are substantially the same, description of them is omitted.

As shown in FIG. 5, the bulb 10 in the third embodiment possesses the annular protruding portion 17 formed along the outer peripheral face of the cavity 5 which is the characteristic of the first above embodiment and the annular protruding portion 16 formed along the circumferential direction of the barrel 14 which the characteristic of the second embodiment. Furthermore, spring members 18, which are fitted to the inside concavity of the protruding portion 17, are provided on the power coupler 20.

In this way, since the annular protruding portion 17 is formed along the outer peripheral face of the cavity 5, when the electrodeless discharge lamp 1 is lit in the base-down lighting, a temperature rise of the bulb neck portion 19 between the protruding portion 16 and the protruding portion 17 and the sealing portion of the bulb 10 is restrained, and the protruding portion 16 and the bulb neck portion 19 become the coldest spots. On the other hand, when the electrodeless discharge lamp 1 is lit in the base-up lighting, the protrusion 4 formed at the apex of the bulb 10 becomes the coldest spot similar to the first and second embodiments. In this way, although a location of the coldest spot is changed corresponding to the posture of installation of the electrodeless discharge lamp 1, it was confirmed that the temperature value of the coldest spot could be maintained substantially constant in each case, when the temperature of the coldest spot was measured. Consequently, a constant optical output can be provided regardless of the posture of installation of the electrodeless discharge lamp 1.

Furthermore, since the spring members 18 provided on the power coupler 20 are fit to utilizing the inside concavity the protruding portion 17, it is possible to fix the bulb 10 and the power coupler 20 stably. In addition, since the lighting apparatus according to the third embodiment is substantially the same as that in the second embodiment shown in FIG. 4, illustration and description are omitted.

Fourth Embodiment

Figure 6:
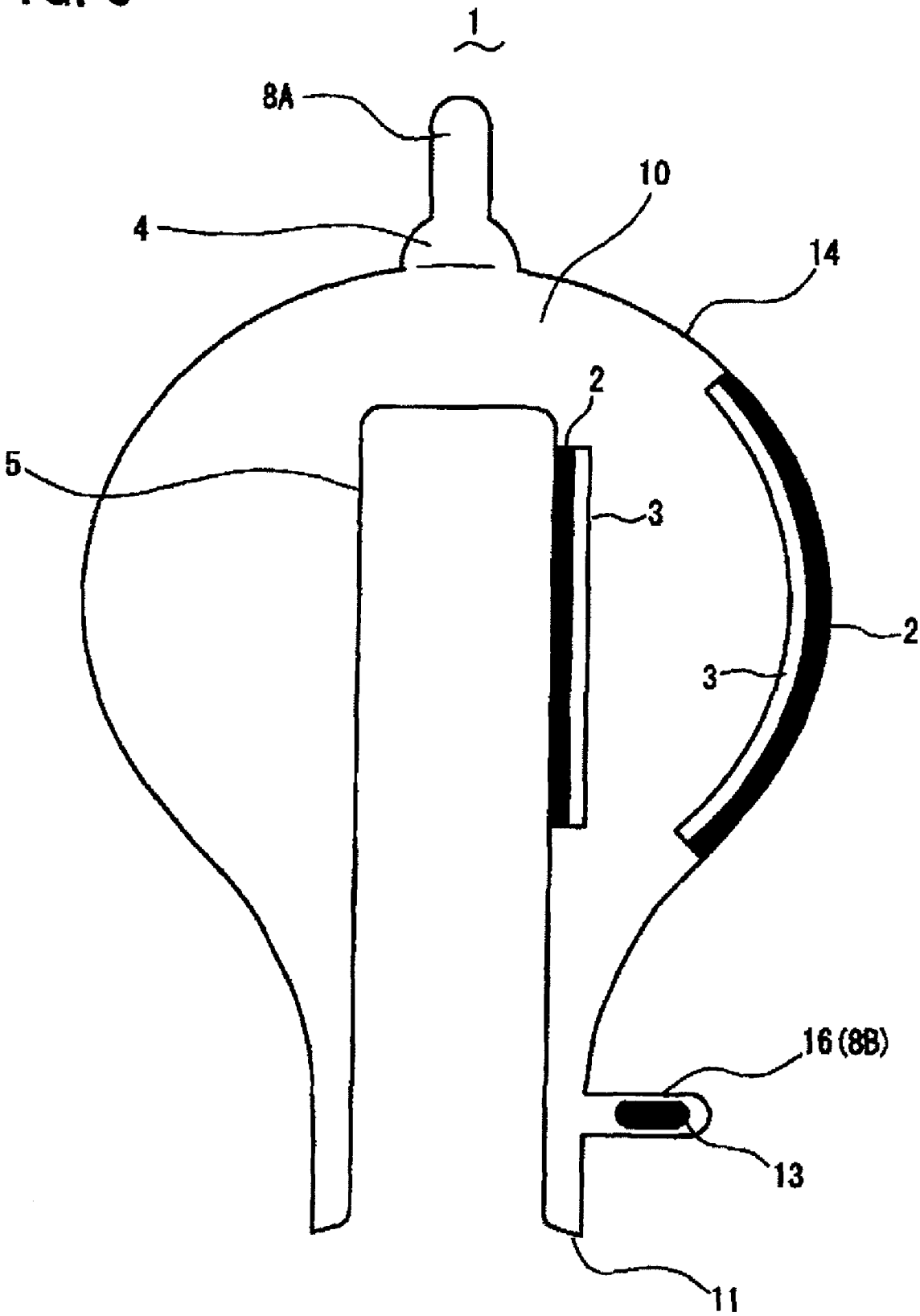
FIG. 6 is a sectional view showing a configuration of an electrodeless discharge lamp in accordance with a fourth embodiment of the present invention.

Subsequently, an electrodeless discharge lamp in accordance with a fourth embodiment of the present invention is described. FIG. 6 shows a configuration of an electrodeless discharge lamp according to the fourth embodiment. In the above mentioned first to third embodiments, although the exhaust tube 8 is provided at the center of the cavity 5, the protrusion 4 and/or the protruding portion 16 are/is used as an exhaust tube or a part of the same in the fourth embodiment when forming the protrusion 4 at the apex of the bulb 10 and the protruding portion 16. Thereby, the shape of the sealing member 11 having the cavity 5 can be simplified, and thus, a manufacturing cost of the electrodeless discharge lamp can be reduced.

The exhaust tube 8 is used to exhaust an internal air and to full a discharge gas such as argon or krypton after welding the barrel 14 and the sealing member 11 in the manufacturing processes of the bulb 10. Therefore, it is not necessarily disposed at the center of the cavity 5. As for the reason why the exhaust tube 8 is conventionally provided at the center of the cavity 5, it is recited to ease the manufacturing of the spherical barrel 14 and to enhance a good appearance of the electrodeless discharge lamp 1. However, it is not need to consider the above reason in the electrodeless discharge lamp 1 in accordance with the present invention, since the protrusion 4 is formed at the apex of the bulb 10. Therefore, in the electrodeless discharge lamp according to the fourth embodiment, a single protruding portion 16, which protrudes outward along the circumferential direction of the barrel 14 constituting the bulb 10, is formed in the vicinity of the sealing portion of the bulb 10, that is, just above the ferrule 15 in a state that the ferrule 15 is disposed downward. In addition, the metal container 13 into which Zn—Hg is filled is provided in the protruding portion 16. Then, both of the protrusion 4 and the protruding portion 16 are used as the exhaust tubes or a part of the same to exhaust impurity gas such as air in the bulb 10 and to fill a discharge gas therein.

As shown in FIG. 6, an exhaust tube 8A having a smaller diameter is formed on the protrusion 4 at the apex of the bulb 10. This is a trace that a glass pile was welded to the protrusion 4 of the barrel 14 in the first embodiment shown in FIG. 1, for example, and used as the exhaust tube, and an opening of the glass pipe was sealed by welding after filling the discharge gas. The protruding portion 16 serving as an exhaust tube 8B having a smaller diameter is formed in the bulb neck portion 19 of the bulb 10. This is a trace that a glass pile is welded to the bulb neck portion 19 of the barrel 14 in the first embodiment shown in FIG. 1, for example, and used as the exhaust tube, and an opening of the glass pipe was sealed by welding after disposition of the metal container 13 and filling the discharge gas.

In this way, it is possible to shorten a time necessary to exhaust the impurity gas and to fill the discharge gas by providing the exhaust tubes 8A and 8B at two places. In particular, by using one to exhaust the impurity gas and the other to fill the discharge gas, it is possible to shorten a time necessary for manufacturing the bulb 10, largely. In addition, the protruding portions 16 each serving as the exhaust tube 8B may be formed at a plurality places so that the same effect can be obtained.

Figure 7:
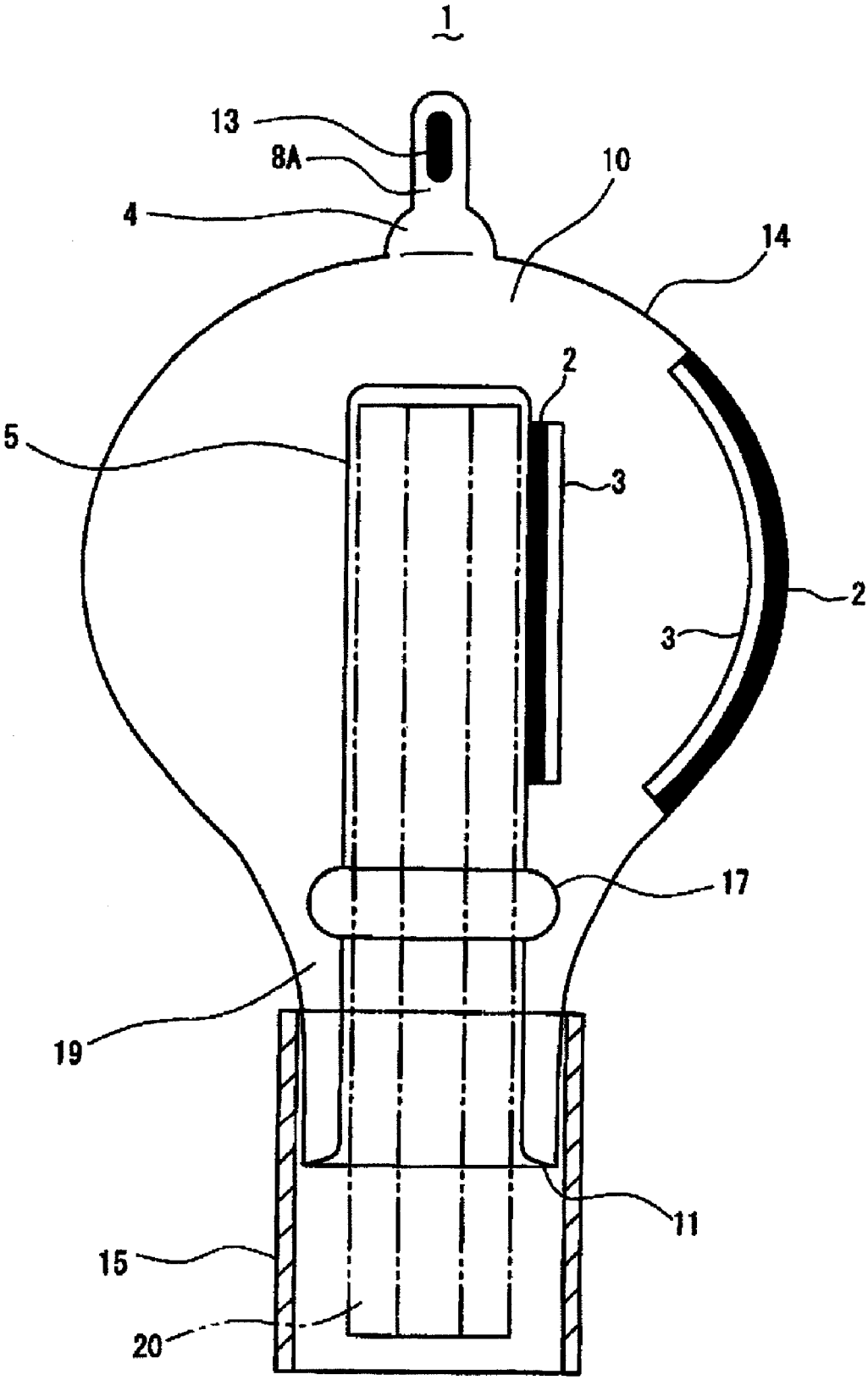
FIG. 7 is a sectional view showing a configuration of a modification of the electrodeless discharge lamp in accordance with the fourth embodiment of the present invention.

Since the present invention is not limited to the configurations of the above mentioned embodiments, various kinds of modification can be applied in a scope where the purpose of the invention is not changed. For example, as shown in FIG. 7, the exhaust tube 8A may be formed on the protrusion 4 at the apex of the bulb 10 and the metal container 13 may be disposed inside the exhaust tube 8A in the configuration of the first to third embodiment, similar to the fourth embodiment. Thereby, the exhaust tube 8 at the center of the cavity 5 can be omitted. In addition, in the fourth embodiment, the exhaust tube 8A of the protrusion 4 can be omitted by enlarging the diameter of the exhaust tube 8B, that is, the protruding portion 16.

The present application is based on Japan patent application No. 2005-84862, the contents of which are hereby incorporated with the present invention by referring to the description and drawings of the above patent application, consequently.

Although the present invention has been fully described by way of example with reference to the accompanying drawings, it is to be understood that various changes and modifications will be apparent to those skilled in the art. Therefore, unless otherwise such changes and modifications depart from the scope of the present invention, they should be construed as being included therein.

The invention claimed is:

1. An electrodeless discharge lamp comprising a bulb into which a discharge gas and a mercury which is controlled at a temperature of a coldest spot are filled, a power coupler that generates a high frequency electromagnetic field, and a ferrule for coupling the bulb and the power coupler, wherein:

the bulb is configured as a barrel formed of a transparent material having an opening, and a sealing member welded to the opening of the barrel and having a cylindrical cavity;

a protrusion formed at an apex of the bulb, which becomes the coldest spot when the lamp is lit in a state in which the ferrule is disposed upward; and a protruding portion formed in a vicinity of a portion of the bulb just above the ferrule so that the vicinity of the portion of the bulb just above the ferrule serves as the coldest spot when the lamp is lit in a state in which the ferrule is disposed downward, the power coupler having spring members which are fitted to an inside cavity of the protruding portion when fitted into the cavity.

2. The electrodeless discharge lamp of claim 1, wherein:

the protruding portion comprises at least one protruding portion or an annular protruding portion formed to protrude inward of the bulb along an outer peripheral face of the cavity just above the ferrule in the state in which the ferrule is disposed downward.

* * * * *